United States Patent [19]

Brooks et al.

[11] 4,249,705

[45] Feb. 10, 1981

[54] METHOD AND APPARATUS FOR DISPENSING FLEXIBLE COILED MATERIALS FROM PALLETS

[75] Inventors: Dannie L. Brooks, Willow Street, Pa.; Ronald S. Fields, Manakin, Va.

[73] Assignee: Reel-O-Matic Systems, Incorporated, Wrightsville, Pa.

[21] Appl. No.: 92,104

[22] Filed: Nov. 7, 1979

[51] Int. Cl.[3] ..... B21C 47/16

[52] U.S. Cl. ..... 242/78.6

[58] Field of Search ..... 242/78.6, 78.7, 78.8

[56] References Cited

U.S. PATENT DOCUMENTS

| | | | |
|---|---|---|---|
| 3,162,394 | 12/1964 | Culpepper | 242/78.6 |
| 3,512,728 | 5/1970 | Johnson | 242/78.6 |
| 3,810,591 | 5/1971 | Haven | 242/78.6 |
| 3,933,322 | 1/1976 | Safzinger | 242/78.6 |

*Primary Examiner*—Edward J. McCarthy

*Attorney, Agent, or Firm*—J. Gibson Semmes

[57] ABSTRACT

Method and apparatus for dispensing unconfined flat coiled strips, mults of which have been stacked in coaxial alignment. The mults form an enlarged cluster coil and in some cases the mults are severably attached to one another. Strip dispensing is effected successively from one coil at a time by means of a turntable upon which the coiled mults are set and associated accessory gear, including supportive coactively mounted coiled snubber and clamping coils, gate and dancer rolls with associated speed control and a pay-out basket assembly, adapted to rotate the dispensed strip to a desired plane. The invention is characterized by eye to the sky dispensing of strips from coils which, aside from the stacking, are otherwise unconfined. In a refined form wherein multiple mults are attached to one another, the strip is peeled from a given mult by a peeling-blade which is associated with the snubber roller.

14 Claims, 3 Drawing Figures

METHOD AND APPARATUS FOR DISPENSING FLEXIBLE COILED MATERIALS FROM PALLETS

DESCRIPTION OF THE PRIOR ART

Strips of metal such as may be later formed by stamping, are coiled into what are commonly termed mults. The current art is known to employ means for dispensing slit mults which have been coaxially attached to one another by means of tabs. In the art, such a cluster of coils is provided with a removable but fixed center core which engages all the mults and a horizontal mandril. This is called eye horizontal dispensing. The uncoilers may be driven or non-driven. Upon rotation of the cluster, peeling of the strips from the mults is effected by a combination knife assembly which has the effect of detaching the strip of one mult from another, during the dispensing of the strip. Because of the requirement of a pre-set core, overhead cranes are required to set such clusters of coils upon an overhung mandril, eye horizontal, prior to strip dispensing. This handling often results in damage to a given cluster of mults; moreover, such systems do not satisfactorily compensate for distortionally formed or asymetric clusters of mults. Again, in the handling thereof, time consuming placement and replacement of the adjustable center core is required, often in an effort to correct the distortion without wholly reforming the cluster of mults. Such present day methods of handling of multiple mults of strip materials are additionally such as to make it difficult in cramped quarters to present the materials substantially horizontally to the press line where the strips are cut, formed, or shaped.

With these deficiencies in mind each resulting in costly and time consuming handling, the invention has as its objectives the most expeditious handling of coiled strips within the metes and bounds of modern day technology. Whereas the invention is described in terms of handling flat coiled metal stock, it is equally useful in the controlled dispensing of other stock having variant cross-section configuration and composition characteristics and wherein multiple coils are stacked upon one another for ease of storage and transfer by lift truck and pallet. The invention in its broadest aspects successfully addresses the dispensing of coiled flexible materials, stacked into mults without attachment to one another.

SUMMARY OF THE INVENTION

The invention in its broadest aspect comprises method and means for efficiently dispensing various flexible strands of coiled materials such as sheet material, wire, cable and the like, coiled strips of film, and/or tape, be they plastic or metal but wherein the coiled strands or strips are stacked upon one another. The primary objective is accomplished by placing a stack or cluster of coils of one such material upon a turntable, eye to the sky, engaging the top-most coil of the stack by clamping rollers on the outer and inner periphery of said coil, driving the turntable while applying tension to the material being dispensed.

Noteworthy is the eye to the sky or upright disposition of the cluster of coils wherein the respective mults of the cluster are unconfined, except for the clamping or compression effect of snubber and clamping rolls. These rolls eliminate the need for installing any type of core within the eye of the cluster of coils. The strip is thus passed through a fixed carriage to reverse direction, thence passed over gate and dancer rolls where speed control is effected, commensurate with the requirement of a treatment line. Where the mults forming the cluster are bonded together by means of conventional tab and the like, the bonds are broken by the peeling action of a uniquely mounted knife assembly. Details of the invention will be apparent from reference to the ensuing drawings.

DESCRIPTION OF THE PREFERRED EMBODIMENTS

Figure 1:
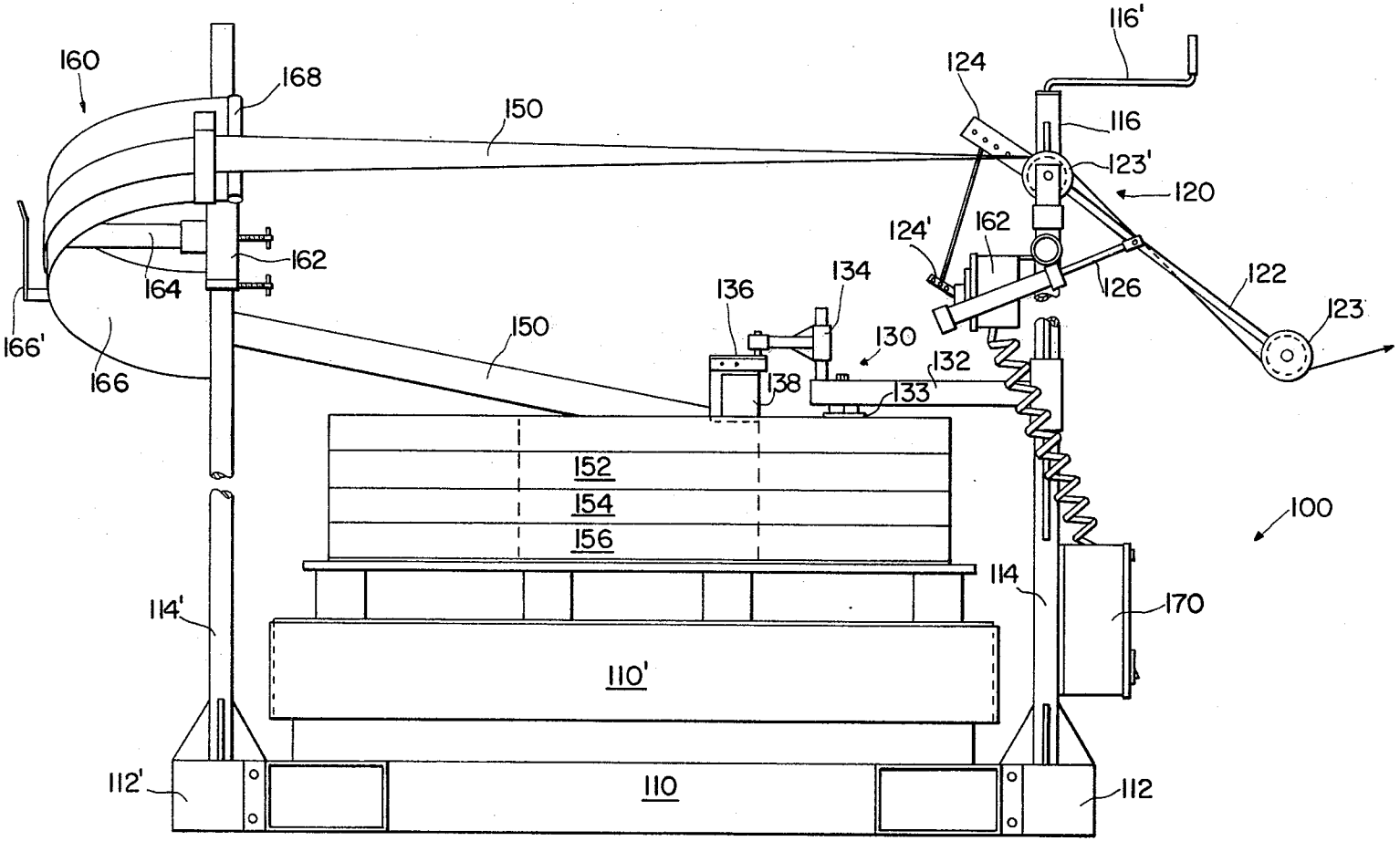
FIG. 1 is a view in side elevation of apparatus in accordance with invention, less the compression roller assembly 140.
Figure 2:
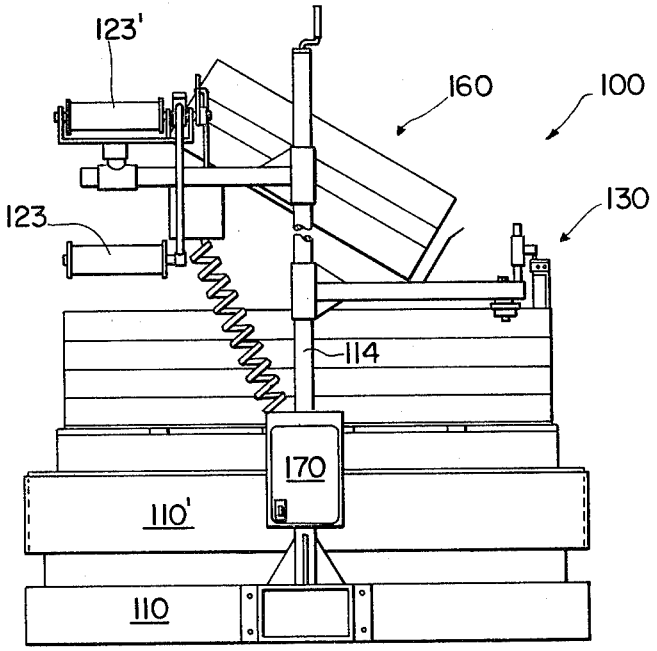
FIG. 2 is an end elevation view of invention.
Figure 3:
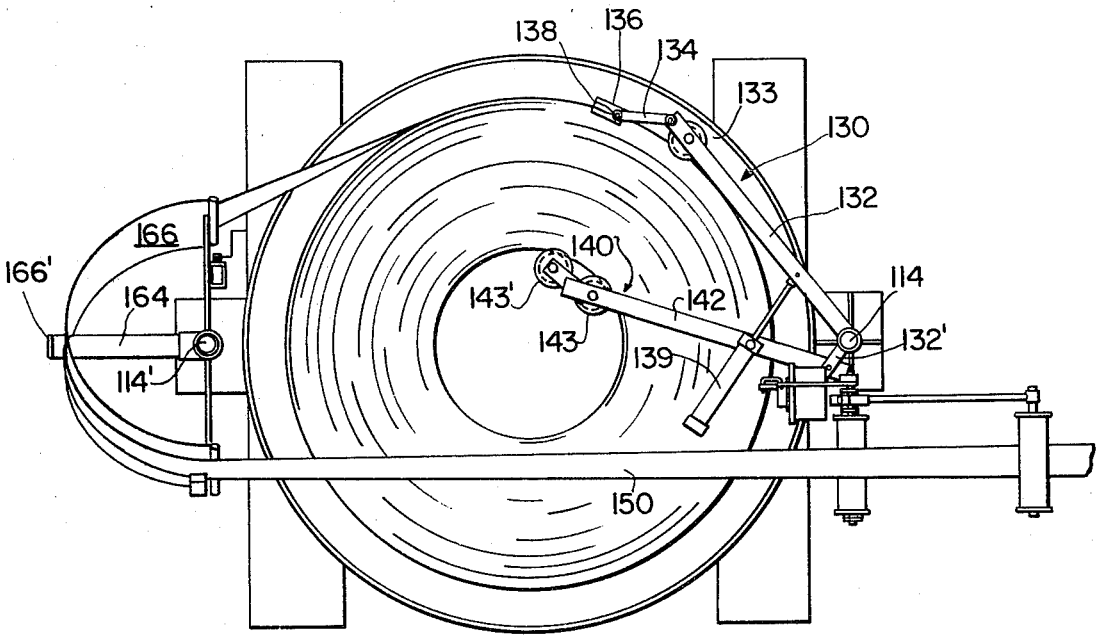
FIG. 3 is a top plan of invention.

A preferred form of the invention is illustrated in FIGS. 1-3, inclusive. In this embodiment the apparatus 100 is adapted to dispense multiple slit metal strips which are stacked upon one another, and secured to one another in coaxial alignment by conventional tabs, not shown. This is commonly known as a cluster coil. Turntable base 110 secures at its outer extremities the extensions 112-112', each anchoring opposed vertical posts 114 and 114' at opposite ends of the device. The turntable base 110 is itself adapted to support the powered turntable 110' upon which may be mounted a pallet carrying the plural mults of a given slit strip material. The top-most mult 150 comprises the threaded strip of even numerical designation and the second through last mults bear the numerals 152-154-156, inclusive. As indicated, the vertical posts are fixed, relative to the powered turntable, post 114 having a telescopic extension which is adapted to vertical adjustment by crank interconnection whereby to raise and lower the elements 120 relative to the press line, not shown.

A vertically adjustable coil or mult clamping system 130-140 is best shown in FIG. 3, wherein it will be noted that the snubber roll arm 132 and its compression roll arm 142 are together in vertically adjustable interconnection with the post 114. They are together freely movable arcuately of the post, after being set in the desirable vertical plane. A control arm 132' extends angularly outwardly from the snubber roll arm 132. Arm 132' is fixed in relation thereto. Corresponding arm 142 of the compression roll arm is pivoted at the free end of the control arm 132' while at the free end of the compression roll arm 142 there is mounted a tandem mount for the compression rolls 143-143', the same being journaled upon a common carriage. All rolls 133-143' are designed to engage a single coil or mult of a cluster. The foremost roll 143 is pivoted in axial connection to the free end of the arm 142, aforesaid. A radian line drawn between rolls 143-143' and axis of roll 133 defines their relative position. All rolls 133 and 143-143' are flanged atop so that they will stay adjacent atop a given mult, holding it down. Interconnecting the respective arms 132 and 142 is a pneumatic compression cylinder which may be air adjustable and pre-set to yield a clamping effect to the rolls 133-143,143'. The cylinder has pivot connection to arm 142 at its inner end and its piston is in pivot connection with the arm 132. The operational effect of this element is to ensure a substantially radial clamping action between the respective snubber roll and the tandem rolls also to exert pressure on the outside and prevent uncoiling regardless of irregularities in the configuration of the multiple coil. The overall effect upon rotation of the coil is to eliminate the need for a multiple coil center core such as is currently required in the eye horizontal dispensing of slit strips.

As indicated, the clamping action of this 130–140 system will ensure stability of positioning of the cluster of mults upon rotating turntable at speeds of 0–130 fpm, the normal rate of feed to a conventional press-line, moreover, where the mults are independent of each other and not secured together, no peeling means are required to effect a dispensing. Peeling means, nonetheless are shown and described hereinafter. Incidentally, in assembly prior to dispensing, the 130–140 combination is pressed downward onto the top-most coiled mult, precedent to rotation thereof.

This clamping combination 130–140 freely rotates horizontally to accomodate imperfections in a clamped coil. The elements 140 are articulated with respect to elements 130 so that as the opposed rollers may be forced radially outward or inward of a true circle, as by contact with a distorted or asymetric coil, the opposed roller systems 130–140 will remain essentially in situ relative to an imaginery given radian. This, with clamping ensures stability to the top-most coil and the mults beneath.

Again, at the free end of the snubber roll arm 132, a pivot trailing arm 134 is linked, the same having pivot connection at the forward most portion of the blade 138 which is mounted in the appropriate extension 136, reference FIG. 1. The effect of the mounting of the blade upon a pivot which is in axial alignment with the knife edge of the blade is such as to give articulation while also ensuring against excessive wandering of the blade, relative to the strip, at the periphery of the mult being dispensed.

Elements 120 forming in part the dancer arm and speed control, may be shifted vertically independently of these elements 130–140 comprising and supporting the compression rolls and snubber roll. In operation, it is desirable that gate roll 123' be at substantially the same height as the press-line which is served by the apparatus 100. The axis of gate roll 123 forms a pivot about which the interconnected dancer roll 123 moves under the restraint of the air-assisted cylinder 126. See FIG. 1. As there shown, the dancer arm bell crank extension 124', serving via suitable pot means 162 to signal an SCR controller 160, the latter having interconnection with the motive means. Thus the press-line draw speed determines speed control of the powered turntable 110, all in accordance with the demands of the press line or other processing system.

A tiltable basket assembly 160 having a coated slide to extend life and to reduce friction is mounted upon the vertical post 114'. This basket includes a vertically adjustable connector 162, a support arm 164 with an arcuate slide 166 to which are attached plural strip retainers 166'. To effect a 90° turn of the strip 150 it will be noted from FIG. 2 that a tilt of substantially 30° to the basket assembly will result in a composite 90° rotation being applied to the strip which is being dispensed from the coil over the gate roller 123' and under the corresponding dancer roll 123. Attached to the interconnecting linkage 122 of the respective gate and dancer rollers is an optionally available air-assisted dancer 126.

Whereas the invention has been described with reference to the dispensing of slit strips, which have been stacked and attached to form a unitary coil, the invention is not so limited, as it will apply equally as well to the dispensing of any coiled materials such as wire, film, tape and the like.

I claim:

1. In the dispensing of flexible materials from coils wherein multiple coils are stacked coaxially upon one another to form an enlarged coil, the combination of:

(A) a rotary turntable supporting eye to the sky an enlarged coil of materials thereon;

(B) a snubber roll and at least one compression roll in coactive interconnection, each being mounted above and detached from the turntable, the said snubber and compression rolls engaging respectively the outer and inner periphery of a topmost coil in clamping relation thereto, the respective snubber and compression rolls being in radial opposition to each other;

(C) means to activate the turntable.

2. The apparatus according to claim 1, further including:

(D) gate and dancer rolls mounted above and detached from the turntable, the latter rolls having control interconnection with activating means and a flexible materials processing line to effect speed control to the means activating the turntable (E) a flexible material peeling-blade adjacent to snubber roll and in trailing relationship thereto.

3. The apparatus according to claim 1, further including:

(E) a flexible material peeling-blade adjacent the snubber roll and in trailing relationship thereto.

4. The apparatus according to claim 2, wherein the clamping rolls are tandem mounted and pivotally offset from the snubber roll, the respective snubber and compression rolls being interconnected for alignment radially of the engaged coil.

5. The apparatus according to claim 3, wherein the peeling-blade is linked to the snubber roll by pivotal interconnection to the leading edge of the blade.

6. The apparatus according to claim 3, further including:

(D) gate and dancer rolls mounted above and detached from the turntable, the latter rolls having control interconnection with activating means and a flexible materials processing line to effect speed control to the means activating the turntable.

7. In the pay-out handling of stacked and tab secured rolls forming an enlarged coil of split strip mults wherein strips of the mults may be dispensed by means of rotary turntable, the combination of:

(A) a rotary turntable supporting eye to the sky an enlarged coil of split strip mults;

(B) a coactively disposed snubber roll and at least one compression roll mounted above and detached from the turntable; the rolls engaging respectively the outer and inner periphery of a top-most mult in clamping relation thereto, the respective snubber and compression rolls being in radial opposition to each other;

(C) a peeling-blade adjacent the snubber and in trailing relationship thereto;

(D) means to activate the turntable.

8. The apparatus according to claim 7, further including a direction transfer assembly which is mounted apart from and in fixed relation to the turntable to effect a rotation of the slit strip relative to the plane of reference of the turntable and enlarged coil of split strip mults.

9. The apparatus according to claim 8, wherein tandem mounted clamping rolls are pivotally offset from the snubber roll.

10. The apparatus according to claim 7, wherein the peeling-blade (C) is linked to the snubber roll by pivotal interconnection to the leading edge of the blade.

11. The apparatus according to claim 7, further including:

(F) gate and dancer rolls mounter above and detached from the turntable, the latter roll having control interconnection with a flexible materials processing line and activating means to effect speed control to the means activating the turntable.

12. The apparatus according to claim 8, including:

(F) gate and dancer roll mounted above and detached from the turntable, the latter roll having control interconnection with a flexible material processing line and activating means to effect speed control to the means activating the turntable.

13. The apparatus according to claim 9, further including:

(F) gate and dancer rolls mounted above and detached from the turntable, the latter roll having control interconnection with a flexible materials processing line and activating means to effect speed control to the means activating the turntable.

14. The apparatus according to claim 10, further including:

(F) gate and dancer rolls mounted above and detached from the turntable, the latter roll having control interconnection with a flexible materials processing line and activating means to effect speed control to the means activating the turntable.

* * * * *